US007397347B1

(12) United States Patent
Joyce

(10) Patent No.: US 7,397,347 B1
(45) Date of Patent: Jul. 8, 2008

(54) DIGITAL CONTACT CASE

(76) Inventor: Jared L. Joyce, Jared Joyce Inc., 1012 W. Babcock, Bozeman, MT (US) 59715

( * ) Notice: Subject to any disclaimer, the term of this patent is extended or adjusted under 35 U.S.C. 154(b) by 223 days.

(21) Appl. No.: 11/270,719

(22) Filed: Nov. 8, 2005

Related U.S. Application Data

(60) Provisional application No. 60/627,108, filed on Nov. 9, 2004.

(51) Int. Cl.
*G08B 1/00* (2006.01)
*A45C 11/04* (2006.01)

(52) U.S. Cl. ..... 340/309.16; 340/309.2; 340/309.3; 340/309.7; 340/686.1; 340/686.6; 206/5.1

(58) Field of Classification Search ..... None
See application file for complete search history.

(56) References Cited

U.S. PATENT DOCUMENTS

| | | | | |
|---|---|---|---|---|
| 2,649,753 | A | 8/1953 | Doyle, Jr. | |
| 4,909,382 | A | 3/1990 | Cuppari | |
| 5,280,834 | A * | 1/1994 | Berkley | 206/5.1 |
| 5,328,597 | A | 7/1994 | Boldt, Jr. et al. | |
| 5,356,012 | A | 10/1994 | Tang et al. | |
| 5,377,614 | A | 1/1995 | Glazer | |
| 5,452,792 | A | 9/1995 | Zautke et al. | |
| 5,699,900 | A * | 12/1997 | Artis | 206/5.1 |
| 5,954,225 | A | 9/1999 | Powe | |
| 6,038,997 | A * | 3/2000 | Madden | 116/308 |
| 6,382,409 | B1 | 5/2002 | Scala | |
| 7,042,805 | B1 * | 5/2006 | Kallman | 368/10 |
| 2005/0258053 | A1 * | 11/2005 | Sieg | 206/5.1 |
| 2006/0187035 | A1 * | 8/2006 | Adams | 340/545.2 |

* cited by examiner

*Primary Examiner*—Julie Lieu
(74) *Attorney, Agent, or Firm*—Robert M Hunter

(57) ABSTRACT

An apparatus and method for counting the number of days that a wearer of contact lenses has used a particular pair of disposable contact lenses. In a preferred embodiment, a digital contact case is provided which comprises a body having two cups for contact lens storage and two reed switches, two caps for covering the cups, each cup having a magnet mounted thereon that closes one of the reed switches when one of the caps is snapped onto one of the cups. Each time both caps are snapped onto the cups, both reed switches are closed and a signal is sent to a microprocessor which increments by one the count of the number of days of contact lens use on a digital display. When the count reaches the number of days recommended by the contact lens manufacturer, the old pair of contact lenses is thrown away, a new pair is placed in the cups and the counter is reset by pressing a reset button.

20 Claims, 6 Drawing Sheets

DIGITAL CONTACT CASE

CROSS-REFERENCE TO RELATED APPLICATIONS

This application claims the benefit of U.S. Provisional Patent Application No. 60/627,108, filed Nov. 9, 2004, now abandoned, the disclosure of which patent application is incorporated by reference as if fully set forth herein.

STATEMENT REGARDING FEDERALLY SPONSORED RESEARCH OR DEVELOPMENT

Not Applicable

BACKGROUND OF THE INVENTION

This invention relates to a digital case for contact lenses. In particular, the invention relates to a digital case for disposable contact lenses.

Disposable contact lenses are stored in contact lens cases that are incapable of displaying the number of days a pair of contact lenses has been used. This is true even though wearers of disposable contact lenses are instructed to dispose of each pair of contact lenses after a stated number of days of use. Wearers are warned that use of a pair of contact lenses for more than the stated number of days of use (which may be 7, 14 or 30 days or another number of days, depending on the brand) may increase the risk of eye infection. For this reason, disposable contact lens wearers who desire to protect their eyes often throw away their contact lenses after 7, 14 or 30 calendar days, even in situations in which the contact lenses are not used every day.

Other contact lens wearers have trouble remembering when their 7, 14 or 30 days of use have occurred. These wearers do not err on the side of safety and throw away their contacts early. Rather, they err on the side of economy and wear their contact lenses for days (even weeks) past the expiration date of the contact lenses.

Thus, some wearers of disposable contact lenses that use background art contact lens cases dispose of their contact lenses too late and face the risk of experiencing eye infections. Other wearers of disposable contact lenses dispose of their contact lenses too early and waste a portion of the purchase price of each pair of contact lenses. What is needed is a solution to these two problems.

The background art is characterized by U.S. Pat. Nos. 2,649,753; 4,909,382; 5,280,834; 5,328,597; 5,356,012; 5,377,614; 5,452,792; 5,699,900; 5,954,225; 6,038,997 and 6,382,409; the disclosures of which patents are incorporated by reference as if fully set forth herein. None of these documents disclose a practical solution to the problem of tracking contact lens use. Background art use tracking contact lens cases require the contact lens wearer to physically advance (and remember to advance) a counter element that indicates to the wearer how many days he has used his contact lenses. Background art use tracking contact lens cases also comprise counters with moving parts and thus are not suitable for use in a bathroom environment in which water is likely to cause failures.

BRIEF SUMMARY OF THE INVENTION

The purpose of the invention is to inform a contact lens wearer of the number of days he has been wearing his contact lenses. One advantage of the invention is that it informs the contact lens wearer when the useful life of a pair of disposable contact lenses has expired. Another advantage is that it motivates a contact lens wearer to throw away expired contact lenses and to purchase new contact lenses sooner. Another advantage of the invention is that it allows a promotional gift to be given to a contact lens wearer when the wearer purchases a new set of disposable contact lenses. Another advantage of the invention is that it provides contact lens wearers with healthier eyes and contact lens manufacturers with increased sales.

In a preferred embodiment, at the beginning of the day, the contact case is closed by the wearer with the contact lenses soaking in the saline solution inside the cups of the contact case. Preferably, the wearer first opens the two lids of the contact case and puts the contact lenses into his eyes. The wearer then preferably rinses out his contact case with water and then, leaving the cups of contact case open, and sets the case somewhere sanitary to dry. At the end of the day, the contact lens wearer preferably adds saline solution to the cups of the contact case and then places his contact lenses into their respective cup locations (indicated by left eye and right eye designations). After the contact lens wearer has placed both contact lenses into their respective cups, the wearer preferably closes the two lids that cover the cups of the contact case. After both lids are closed, the digital counter adds one to the count indicated on the liquid crystal display (LCD).

After repeating these process steps on multiple days, the pair of contact lenses that are in use eventually reach their expiration date (e.g., after 7, 14, 30 days of use, etc.). On the day that the lenses have expired, in a preferred embodiment, the liquid crystal display (LCD) of the invention displays the maximum recommended days of lens use. On this day, the wearer does not go through with his regular evening routine of taking his contact lenses out of his eyes and placing them in the contact case. Instead, the wearer takes the contact lenses out of his eyes, disposes of them, and then presses the reset button on the contact case, at which time the LCD is reset to zero. At the beginning of the next day of use, the wearer puts a new pair of contact lenses into his eyes and resumes the steps described above until once again the contact lenses have been used for the number of days suggested by the manufacturer.

In use, a preferred embodiment of the invention is operated by a disposable contact lens wearer who places his contact lenses in the digital contact case at the end of the day and removes them from the digital contact case at the beginning of the day. Upon closure of both of the caps of the digital contact case, a digital counter increases by one. In a preferred embodiment, the counter has a range of 0-99.

In a preferred embodiment, a toggling operation is supported in which the contact lens wearer presses and releases a time button to toggle back and forth between a time display and a counter display. In a resetting operation, the contact lens wearer presses and releases a reset button to reset the counter. In a clock setting operation, the contact lens wearer ensures that both caps are closed and then, presses and holds a time button, and presses and releases the reset button to advance the hours display by a factor of one. The wearer repeats process with both caps open to advance the minutes display. In a preferred embodiment, electronics compartment of the case is completely sealed, waterproof and contains a non-removable battery.

In alternative embodiments, the digital contact case is motion activated (e.g., is activated by picking it up), has lights, and is capable of recording memos, playing a recorded question (e.g., "Did you take your medicine?"), playing other sounds and/or taking photographs. Alternative embodiments comprise flip top case styles and screw top case styles. In other alternative embodiments, the components of the case have different colors. Other alternative embodiments dispense toothpaste or comprise a strip indicating when the case should be thrown away because the integrity of the plastic has decreased.

In a preferred embodiment, the invention is a digital contact case for storage of disposable contact lenses comprising: a base; a display mounted on said base that is operative to display one of a plurality of numbers; a first compartment that is mounted on or is an integral part of said base and is configured for storage of a disposable contact lens for a left eye, said first compartment having a first cap and means for sending a first signal when a first cap state of said first cap changes from opened to closed; a second compartment that is mounted on or is an integral part of said base and is configured for storage of a contact lens for a right eye, said second compartment having a second cap and means for sending a second signal when a second cap state of said second cap changes from opened to closed; a processing unit that is attached to said base and is operative to increment a previous number of uses when it receives both said first signal and said second signal to produce a current number of uses and to cause said display to display said current number of uses; and a source of power for said display and said processing unit. Preferably, the digital contact case further comprises: a time button mounted on said base; wherein said time button is operative to toggle said display between displaying said current number of uses of both contact lenses and displaying a current time when said time button is pressed. Preferably, the digital contact case further comprises: a reset button mounted on said base; wherein said reset button is operative to reset said current number of uses to zero when said reset button is pressed. Preferably, the digital contact case further comprises: a first button mounted on said base; and a second button mounted on said base; wherein said first button is operative to advance an hour value displayed in said display by one when said first button is pressed while said second button is held down and both caps are closed; and wherein said first button is operative to advance a minutes value displayed in said display by one when it said first button pressed while the second button is held down and both caps are open.

In another preferred embodiment, the invention is a counting device comprising: a display for displaying a number; a first compartment having a first opening and a first cap, said first opening being capable of being open or being closed by said first cap; a second compartment having a second opening and a second cap, said second opening being capable of being open and being closed by said second cap; means for counting, said means for counting being operative to automatically sense that a use has occurred when both of said openings have changed from being open to being closed and being operative to increase said number being displayed by said display when said use is automatically sensed. Preferably, the counting device further comprises: a base on which said display and both of said compartments have been mounted and within which at least a portion of said means for counting is contained.

In yet another preferred embodiment, the invention is a digital contact case comprising: means for storing having one openable and closable compartment for storage of a contact lens for a first eye and a second openable and closable compartment for storage of a contact lens for a second eye, each of said compartments having an open condition and a closed condition; and means for counting and displaying the number of times both compartments have been placed in the closed condition after at least one compartment has been placed in the open condition; wherein said means for counting and displaying is automatically actuated by both compartments being placed in the closed condition after at least one compartment has been placed in the open condition. Preferably, each of said compartments has a cap and wherein said means for counting and displaying comprises two proximity sensors, each of which proximity sensors is operative to sense when one of said caps has been placed in a position that places one of said compartments in said closed condition. Preferably, said means for storing comprises a base and each of said proximity sensors comprises a permanent magnet that is affixed to one of said caps and a reed switch that is mounted in said base. Preferably, said means for counting and displaying comprises a liquid crystal display, said liquid crystal display being operative to display a new number when both of said proximity sensors senses that both of said caps have been placed in a position that places both of said compartments in said closed condition.

Further aspects of the invention will become apparent from consideration of the drawings and the ensuing description of preferred embodiments of the invention. A person skilled in the art will realize that other embodiments of the invention are possible and that the details of the invention can be modified in a number of respects, all without departing from the concept. Thus, the following drawings and description are to be regarded as illustrative in nature and not restrictive.

BRIEF DESCRIPTION OF THE SEVERAL VIEWS OF THE DRAWINGS

The features of the invention will be better understood by reference to the accompanying drawings which illustrate presently preferred embodiments of the invention. In the drawings.

Figure 1:
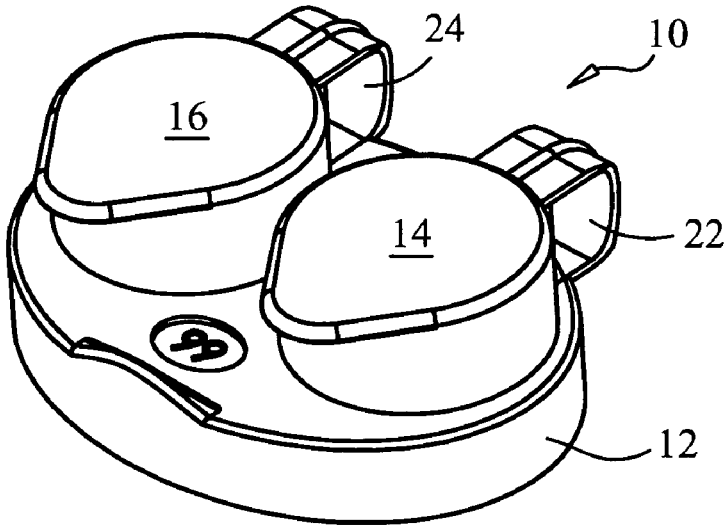
FIG. 1 is an isometric view of a preferred embodiment of the invention with the digital contact case in the closed position.
Figure 2:
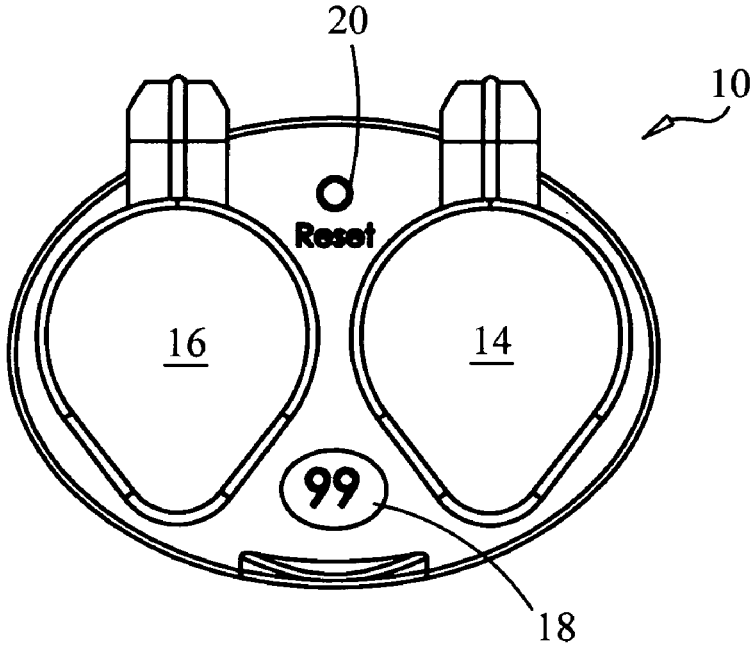
FIG. 2 is a plan view of a preferred embodiment of the invention with the digital contact case in the closed position.
Figure 3:
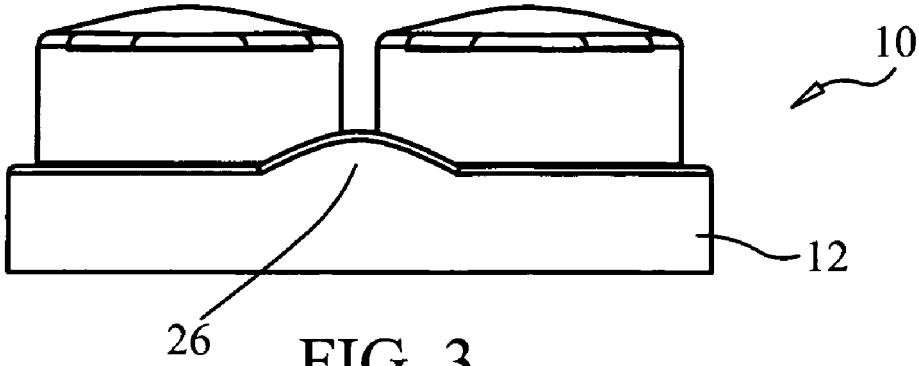
FIG. 3 is a front elevation view of a preferred embodiment of the invention.
Figure 4:
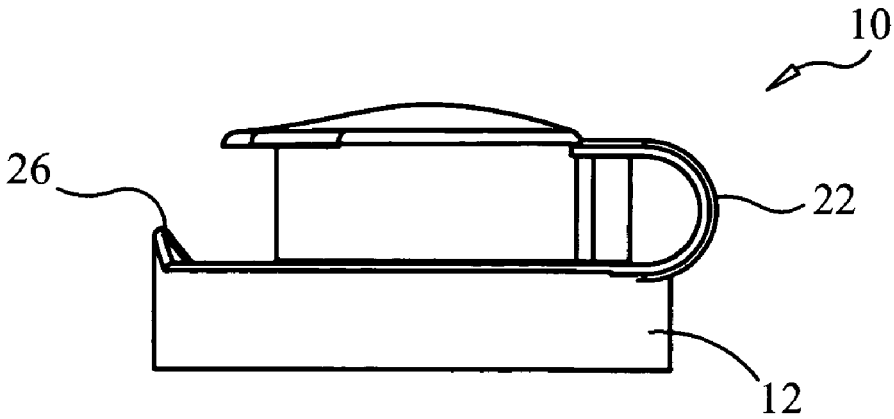
FIG. 4 is a side elevation view of a preferred embodiment of the invention.

The following reference numerals are used to indicate the parts and environment of the invention on the drawings:

10 digital contact case, contact case, case
12 body, base
14 right cap, right lid
16 left cap, left lid
18 digital display
20 reset button
22 right living hinge
24 left living hinge
26 thumb tab
30 circuit board, printed circuit board

32 bottom cover
34 right mounting post
36 left mounting post
40 right magnet holder
42 left magnet holder
44 right cup
46 left cup
50 microprocessor
52 battery
54 right reed switch
56 left reed switch

DETAILED DESCRIPTION OF THE INVENTION

Referring to FIGS. 1-4, a preferred embodiment of digital contact case 10 is presented. Digital contact case 10 comprises body 12, right cover 14, left cover 16, digital display 18 and reset button 20. Right cover 14 is attached to body 12 by right living hinge 22 and left cover 16 is attached to body 12 by left living hinge 24.

Figure 6:
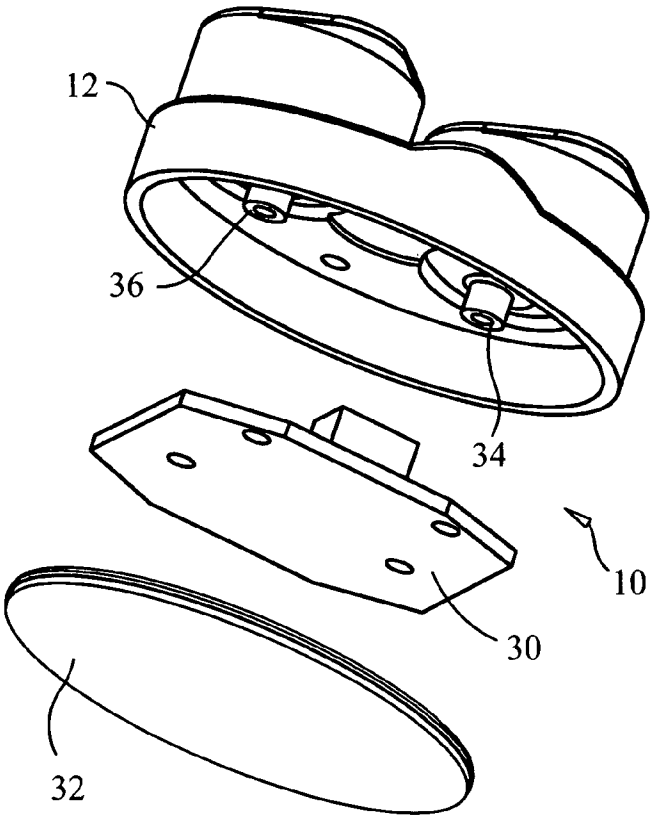
FIG. 6 is an exploded view from below of a preferred embodiment of the invention.
Figure 5:
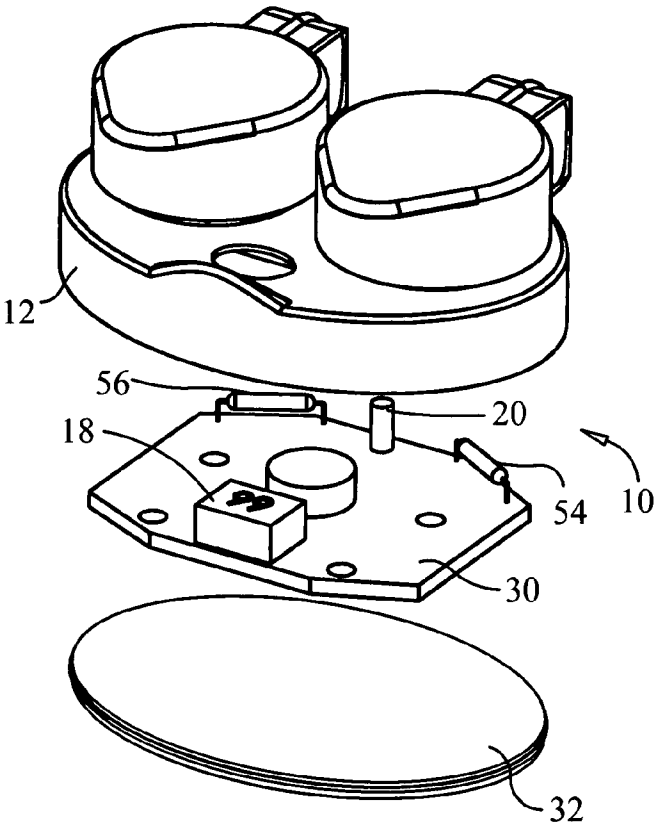
FIG. 5 is an exploded view from above of a preferred embodiment of the invention.

Exploded views of digital contact case 10 are presented in FIGS. 5 and 6. In these views, circuit board 30 and bottom cover 32 are shown. Digital display 18 and reset button 20 are mounted on circuit board 30. Circuit board 30 is preferably attached to base 12 by means of screws (not shown) that are screwed through circuit board 30 and into right mounting post 34 and left mounting post 36, which are visible in FIG. 6. Right reed switch 54 and left reed switch 56 are preferably mounted directly on circuit board 30 as shown in FIG. 6.

Figure 7:
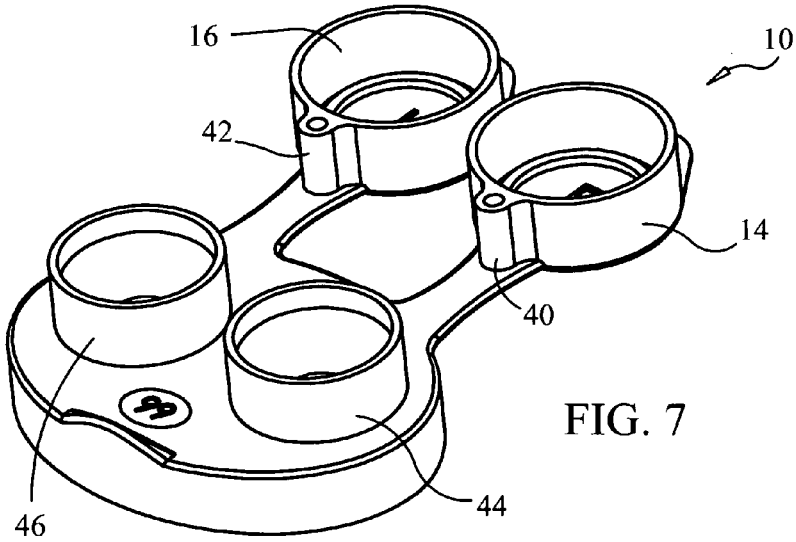
FIG. 7 is an isometric view of a preferred embodiment of the invention with the digital contact case in the open position.
Figure 8:
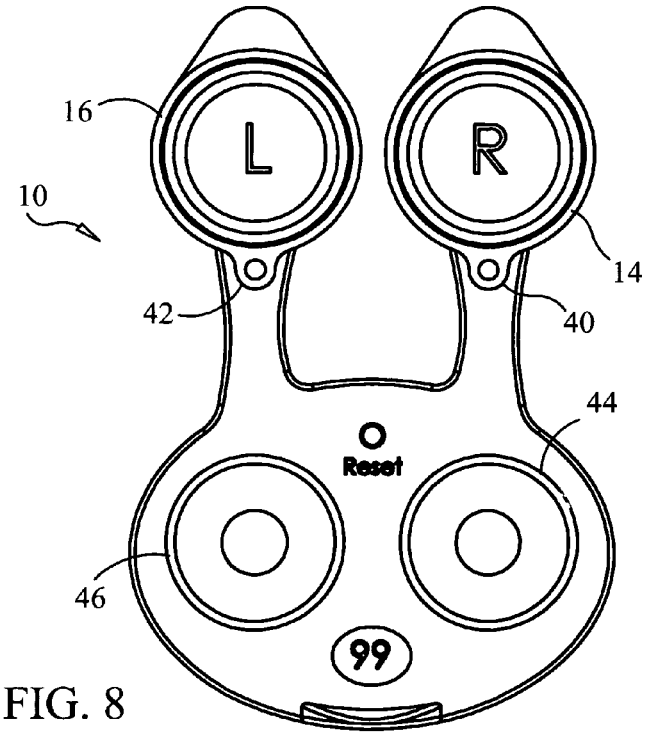
FIG. 8 is a plan view of a preferred embodiment of the invention with the digital contact case in the open position.

Referring to FIGS. 7 and 8, digital contact case 10 is shown in the open position. In this view, right magnet holder 40 and left magnet holder 42 are shown. The magnets of the invention are preferably mounted in right magnet holder 40 and left magnet holder 42. Also, in this view, right cup 44 and left cup 46 into which the user's contact lenses are deposited are shown. In a preferred embodiment, right cap 14 snaps onto right cup 44 and left cap 16 snaps onto left cup 46. Thumb tab 26 provides a structure for the contact lens wearer to grasp body 12 when snapping caps 14 and 16 off of cups 44 and 46.

Figure 9:
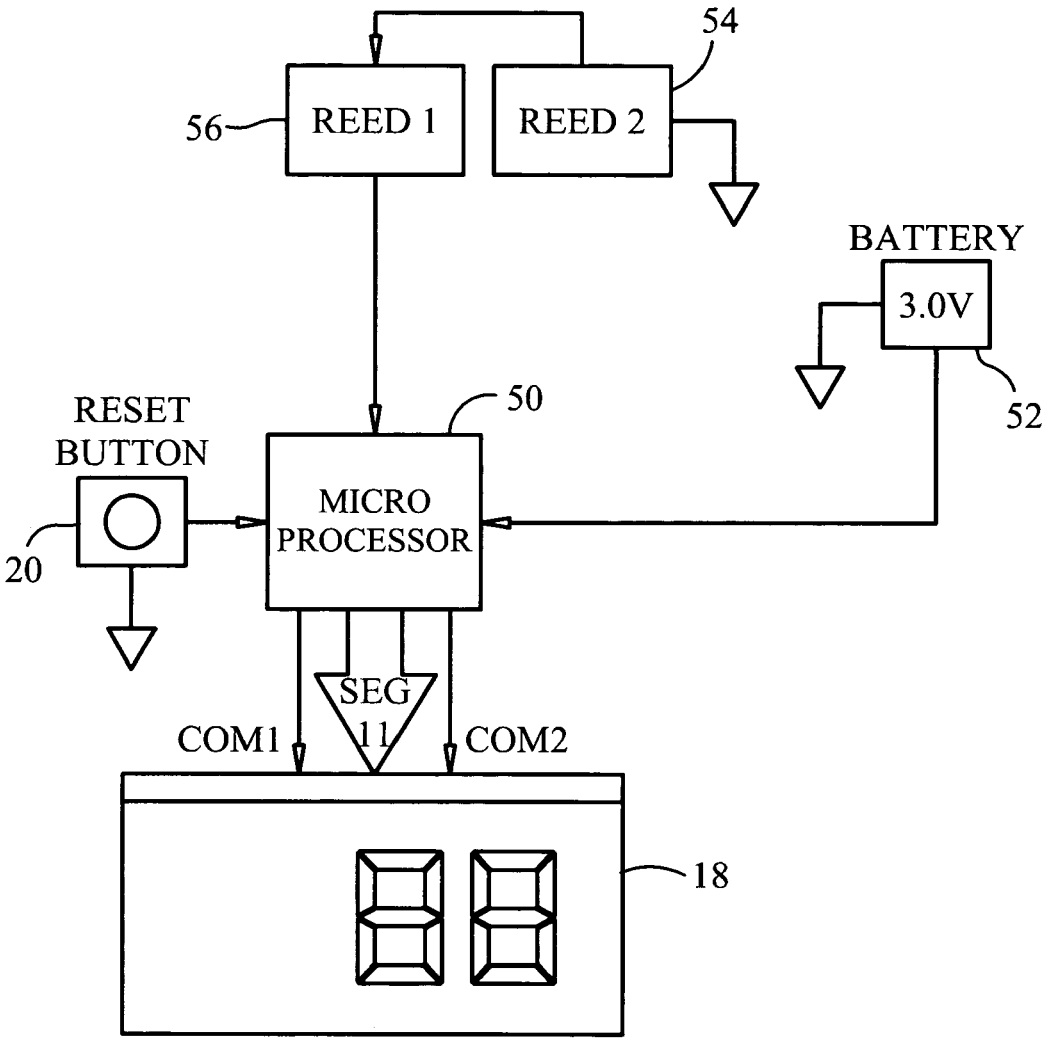
FIG. 9 is a schematic block diagram of the electrical components of a preferred embodiment of the invention.

Referring to FIG. 9, a schematic block diagram of the electrical components of digital contact case 10 is presented. Microprocessor 50 is powered by battery 52. Right reed switch 54 and left reed switch 56 are connected in series to microprocessor 50. Reset button 20 provides input signals to microprocessor 50. Microprocessor 50 provides signals to digital display 18.

Figure 10:
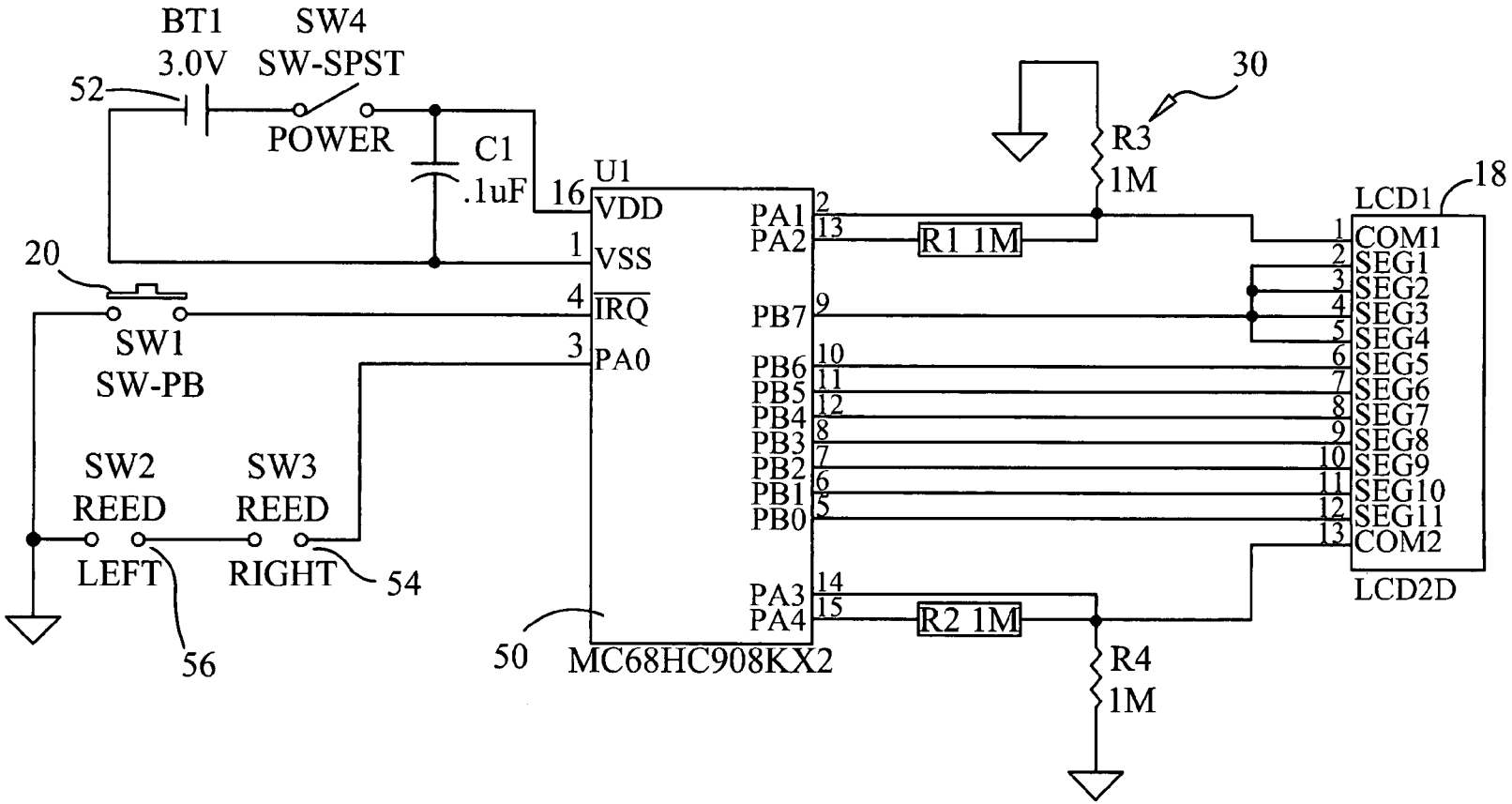
FIG. 10 is a schematic circuit diagram of the electrical components of a preferred embodiment of the invention.

Referring to FIG. 10, a schematic circuit diagram for a preferred embodiment circuit board 30 of digital contact case 10 is presented. This diagram illustrates the connections among microprocessor 50, digital display 18, reset button 20, battery 52, right reed switch 54 and left reed switch 56.

In a preferred embodiment, operation of digital contact case 10 involves the contact lens wearer's placing a new right contact lens into right cup 44 and snapping right cap 14 onto right cup 44. When right cap 14 is in the closed position, the proximity of the magnet in right magnet holder 40 to right reed switch 54 causes it to close. Similarly, a new left contact lens is placed into left cup 46 and left cap 16 is snapped onto left cup 46. When left cap 16 is in the closed position, the proximity of the magnet in left magnet holder 42 to left reed switch 56 causes it to close. When both reed switches are in the closed position, a signal is sent to microprocessor 50. When the contact wearer wishes to reset to zero the number displayed on digital display 18, reset button is pressed and held down for at least three seconds with both reed switches in either the open or the closed position.

In use of a preferred embodiment, the caps are opened at the beginning of the day or at that time of day at which the wearer wishes to begin wearing his contact lenses. The caps are left open when the contact lenses are in use. At the end of the day or at the time of day at which the wearer wishes to stop wearing his contact lenses, the contact lenses are placed in the cups and both caps are closed, causing the counter to count one day of use. In a preferred embodiment, if only one cap is closed, the counter does not count. These steps are repeated until the counter has counted the number of days that the manufacturer recommends that each pair of contact lenses be used.

In an alternative embodiment, a signal is sent to the microprocessor when both caps (or reed switches) are opened after being closed. This signal causes the display to increment the number displayed by one. In yet another alternative embodiment, means (e.g., another button) are provided that allow a contact lens wearer who wears only one contact lens to set up the digital contact case so that only one of the caps has to be closed (or opened) for the counter to increase by one. In another alternative embodiment, the switches are mounted on the caps and the means for activating the switches are mounted on the body of the digital contact case. In yet another alternative embodiment, the number of days of use is not displayed but rather a (e.g., sound or light) signal is given to the wearer when the recommended number of days of use has been reached. In another embodiment, buttons are not provided but rather a certain sequence of opening or closing one or both of the caps resets the counter. In another alternative embodiment, the battery is replaceable and/or rechargeable. In another alternative embodiment, another conventional type of proximity switch other than a reed switch is used. In another alternative embodiment, the wearer is instructed to leave the caps of contact case in the closed position during the day and two pairs of cap closures are required to cause the counter to increment by one, instead of just one pair of cap closures. In another embodiment, all of the electronic components of the invention (e.g., the proximity sensor, the processor, the circuit) are provided on a single chip and take the form of a micro-electro-mechanical device.

Many variations of the invention will occur to those skilled in the art. Some variations include alternative means for fastening the caps to the cups. Other variations call for alternative structures to be provided to allow the digital contact case to perform other functions. All such variations are intended to be within the scope and spirit of the invention.

Although some embodiments are shown to include certain features, the applicant specifically contemplates that any feature disclosed herein may be used together or in combination with any other feature on any embodiment of the invention. It is also contemplated that any feature may be specifically excluded from any embodiment of an invention.

What is claimed is:

1. A digital contact case for storage of disposable contact lenses comprising:

a base;

a display mounted on said base that is operative to display one of a plurality of numbers;

a first compartment that is mounted on or is an integral part of said base and is configured for storage of a disposable contact lens for a left eye, said first compartment having a first cap and means for sending a first signal when a first cap state of said first cap changes from opened to closed;

a second compartment that is mounted on or is an integral part of said base and is configured for storage of a contact lens for a right eye, said second compartment having a second cap and means for sending a second signal when a second cap state of said second cap changes from opened to closed;

a processing unit that is attached to said base and is operative to increment a previous number of uses when it receives both said first signal and said second signal to produce a current number of uses and to cause said display to display said current number of uses; and a source of power for said display and said processing unit.

2. The digital contact case of claim 1 further comprising:

a time button mounted on said base;

wherein said time button is operative to toggle said display between displaying said current number of uses of both contact lenses and displaying a current time when said time button is pressed.

3. The digital contact case of claim 1 further comprising:

a reset button mounted on said base;

wherein said reset button is operative to reset said current number of uses to zero when said reset button is pressed.

4. The digital contact case of claim 1 further comprising:

a first button mounted on said base; and a second button mounted on said base;

wherein said first button is operative to advance an hour value displayed in said display by one when said first button is pressed while said second button is held down and both caps are closed; and wherein the first button is operative to advance a minutes value displayed in said display by one when said first button is pressed while said second button is held down and both caps are open.

5. The digital contact case of claim 1 wherein said means for sending a first signal and said means for sending a second signal each comprise a magnet having a magnetic field and a reed switch that is switched to the closed position when said reed switch is within said magnetic field.

6. The digital contact case of claim 5 wherein each of said magnets is mounted in a different one of said caps and each of said reed switches is mounted on a circuit board that is fixed within said base.

7. The digital contact case of claim 6 wherein said reed switches are connected in series on said circuit board and closure of both of them is operative to produce both said first signal and said second signal.

8. The digital contact case of claim 6 wherein said reed switches are connected in parallel on said circuit board and closure of one of them is operative to produce said first signal and closure of another of them is operative to produce said second signal.

9. A digital contact case for storage of disposable contact lenses comprising:

a base;

a display mounted on said base that is operative to display one of a plurality of numbers;

a first compartment that is mounted on or is an integral part of said base and is configured for storage of a disposable contact lens for a left eye, said first compartment having a first cap and means for producing a first switch actuation when a first cap state of said first cap changes from opened to closed;

a second compartment that is mounted on or is an integral part of said base and is configured for storage of a contact lens for a right eye, said second compartment having a second cap and means for producing a second switch actuation when a second cap state of said second cap changes from opened to closed;

a processing unit that is attached to said base and is operative to increment a previous number of uses when both switch actuations occur to produce a current number of uses and to cause said display to display said current number of uses; and a source of power for said display and said processing unit.

10. The digital contact case of claim 9 further comprising:

a time button mounted on said base;

wherein said time button is operative to toggle said display between displaying said current number of uses of both contact lenses and displaying a current time when said time button is pressed.

11. The digital contact case of claim 9 further comprising:

a reset button mounted on said base;

wherein said reset button is operative to reset said current number of uses to zero when said reset button is pressed.

12. The digital contact case of claim 9 further comprising:

a first button mounted on said base; and a second button mounted on said base;

wherein said first button is operative to advance an hour value displayed in said display by one when said first button is pressed while said second button is held down and both caps are closed; and wherein the first button is operative to advance a minutes value displayed in said display by one when said first button is pressed while said second button is held down and both caps are open.

13. The digital contact case of claim 9 wherein said means for sending a first signal and said means for sending a second signal each comprise a magnet having a magnetic field and a reed switch that is switched to the closed position when said reed switch is within said magnetic field.

14. The digital contact case of claim 13 wherein each of said magnets is mounted in a different one of said caps and each of said reed switches is mounted on a circuit board that is fixed within said base.

15. The digital contact case of claim 14 wherein said reed switches are connected in series on said circuit board and closure of both of them is operative to produce both said first signal and said second signal.

16. The digital contact case of claim 14 wherein said reed switches are connected in parallel on said circuit board and closure of one of them is operative to produce said first signal and closure of another of them is operative to produce said second signal.

17. A digital contact case comprising:

means for storing having one openable and closable compartment for storage of a contact lens for a first eye and a second openable and closable compartment for storage of a contact lens for a second eye, each of said compartments having an open condition and a closed condition; and means for counting and displaying the number of times both compartments have been placed in the closed condition after at least one compartment has been placed in the open condition;

wherein said means for counting and displaying is automatically actuated by both compartments being placed in the closed condition after at least one compartment has been placed in the open condition.

18. The digital contact case of claim 17 wherein each of said compartments has a cap and wherein said means for counting and displaying comprises two proximity sensors, each of which proximity sensors is operative to sense when one of said caps has been placed in a position that places one of said compartments in said closed condition.

19. The digital contact case of claim 18 wherein said means for storing comprises a base and each of said proximity sensors comprises a permanent magnet that is affixed to one of said caps and a reed switch that is mounted in said base.

20. The digital contact case of claim 19 wherein said means for counting and displaying comprises a liquid crystal display, said liquid crystal display being operative to display a new number when both of said proximity sensors senses that both of said caps have been placed in a position that places both of said compartments in said closed condition.

* * * * *